US007078639B2

(12) United States Patent
Poyner

(10) Patent No.: US 7,078,639 B2
(45) Date of Patent: Jul. 18, 2006

(54) SWITCH MECHANISM WITH SEAL

(75) Inventor: Julian Poyner, Stockport Cheshire (GB)

(73) Assignee: EJA Limited, Wigan (GB)

( * ) Notice: Subject to any disclaimer, the term of this patent is extended or adjusted under 35 U.S.C. 154(b) by 0 days.

(21) Appl. No.: 11/094,398

(22) Filed: Mar. 30, 2005

(65) Prior Publication Data

US 2005/0224328 A1 Oct. 13, 2005

(30) Foreign Application Priority Data

Apr. 7, 2004 (GB) ..... 0407996.8

(51) Int. Cl.
*H01H 9/20* (2006.01)

(52) U.S. Cl. ..... 200/334; 200/302.2

(58) Field of Classification Search ..... 200/330, 200/302.1, 302.2, 334, 302.3, 17 R, 61.62, 200/50 A, 43.07, 43.01, 50 R, 43.04, 43.05, 200/43.06, 43.08, 43.09
See application file for complete search history.

(56) References Cited

U.S. PATENT DOCUMENTS 3,940,585 A * 2/1976 Schaad ..... 200/530
5,152,540 A * 10/1992 Kuze ..... 277/634
5,587,569 A 12/1996 Mohtasham
5,817,997 A * 10/1998 Wernig ..... 200/16 R
6,046,420 A * 4/2000 DeMoss ..... 200/534
6,407,653 B1 * 6/2002 Zindler et al. ..... 335/6
6,747,225 B1 * 6/2004 Yu ..... 200/334
6,949,711 B1 * 9/2005 Litteer ..... 200/43.01

FOREIGN PATENT DOCUMENTS

EP 1 255 262 A3 1/2003
EP 1 376 632 A1 1/2004

* cited by examiner

*Primary Examiner*—Michael Friedhofer
*Assistant Examiner*—Lisa Klaus
(74) *Attorney, Agent, or Firm*—Quarles & Brady, LLP; William R. Walbrun

(57) ABSTRACT

A switch mechanism embodying the invention comprises a switch head assembly with at least one stationary contact and at least one movable contact carried by an axially movable contact carrier, a cam head assembly, a plunger assembly with a sealing element and a U-shaped yoke. The sealing element comprises a bellows seal having an outer peripheral rim that is trapped between the switch assembly housing and the tulip end of the cam head housing on assembly thereof. The bellows seal further comprises an inner annular part that is over molded onto the plunger body where and has a relieved portion comprising V-shaped troughs and ridges and undercutting in the form of annular grooves that open towards one another. The relieved portion provides a positive connection between the sealing element and the plunger and the tracking path for preventing liquid ingress is increased significantly.

20 Claims, 1 Drawing Sheet

SWITCH MECHANISM WITH SEAL

TECHNICAL FIELD

The present invention relates to a switch mechanism with seal, especially, but not exclusively, to a safety switch mechanism used with machinery guards enclosing kinetic machinery.

BACKGROUND ART

In a known safety switch mechanism that is adapted to be fitted to an enclosure having a door, gate or protective cover, the switch assembly is adapted to switch OFF an electrical power supply when the door, gate or protective cover is opened. The known safety switch mechanism comprises a safety switch assembly adapted to be fitted to the enclosure and an actuator adapted to be fitted to the door, gate or protective cover, and insertable into the safety switch assembly to turn ON the electrical power when the enclosure is closed by the door, gate or protective cover.

The safety switch assembly comprises within a housing at least a pair of contacts, one set stationary and the other movable and carried by an axially movable carrier. In one known device movement of the carrier is controlled by a rotary cam mechanism rotatably mounted in a cam housing which actuates a plunger for the carrier to transmit movement of the rotary cam mechanism to the contact carrier.

The part of the housing accommodating the contacts, hereinafter referred to as the contact housing, has to be sealed to inhibit the ingress of water and dirt and to that end a sealing element in the form of a bellows seal is used. It has an outer peripheral rim and an inner peripheral rim. The latter is fitted onto the plunger and the former is trapped between the cam housing and the contact housing on assembly thereof.

Fitting of the inner periphery of the bellows seal on to the plunger limits the shape and/or design of the plunger to one that will accept the inner periphery of the seal. Furthermore, repeated operation of the plunger can impair sealing efficiency of the seal with the plunger. Furthermore, fitting of the seal onto the plunger complicates the assembly procedure. It is an aim of the present invention to provide an improved construction.

SUMMARY OF THE INVENTION

Accordingly, a first aspect of the invention provides a safety switch mechanism comprising a housing accommodating a contact assembly including at least one stationary contact and at least one movable contact carried by an axially movable carrier, an operating mechanism for the movable carrier and a plunger transmitting movement of the operating mechanism to the movable carrier, and wherein the plunger carries sealing means in the form of an annular bellows seal having a peripheral rim adapted to be cooperate with a housing part and an inner peripheral rim that contacts the plunger, and wherein the bellows seal is overmolded onto the plunger.

A second aspect of the invention provides a plunger for a safety switch assembly comprising a plunger body and having over-molded thereon a bellows seal.

A third aspect of the invention provides a method of making a switch plunger and seal assembly comprising forming a plunger from a first material, inserting the preformed plunger into a mold and over-molding onto the plunger a bellows seal.

The plunger may be made from any convenient material but usually it will be a plastics material. Usually the plunger will be made in a molding process. The material of the bellow seal is preferably a flexible rubber like plastics.

More particularly the plunger is formed with surface relieving to accept the bellows material. More preferably still the relieving may include a series of troughs and recesses. Yet more preferably the relieving includes at least one undercut and preferably two undercuts disposed to face one another.

BRIEF DESCRIPTION OF THE DRAWINGS

The present invention will now be described further hereinafter, by way of example only, with reference to the accompanying drawings; in which:—

DESCRIPTION OF THE PREFERRED EMBODIMENTS

Figure 1:
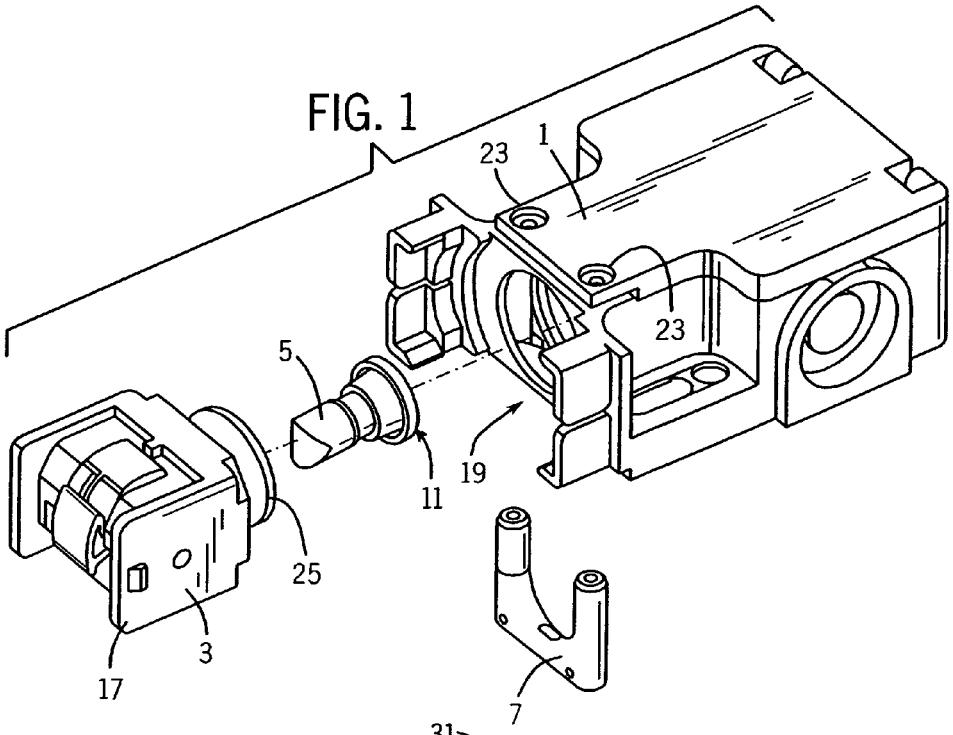
FIG. 1 is an exploded perspective view of a safety switch mechanism embodying the present invention.
Figure 2:
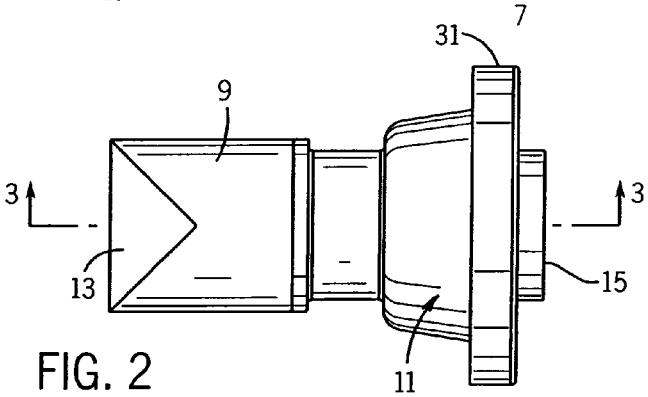
FIG. 2 is a plan view of a plunger assembly used in the embodiment of FIG. 1.
Figure 3:
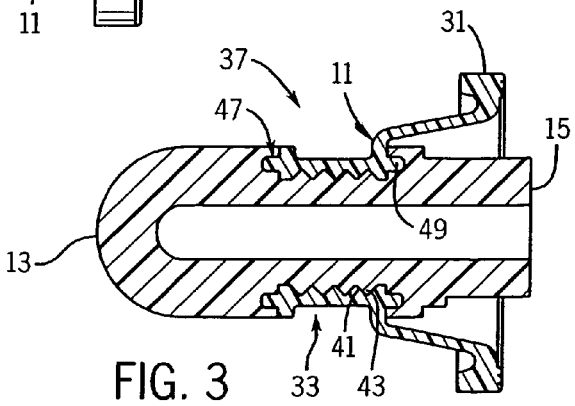
FIG. 3 is a section on A—A of FIG. 2.

Referring to the drawings, a switch mechanism embodying the invention comprises a switch head assembly 1, a cam head assembly 3, a plunger assembly 5 and a yoke 7. The switch head assembly 1 accommodates at least one contact set comprising at least one stationary contact and at least one movable contact carried by an axially movable contact carrier as is common in the art and hence not described in any further detail.

The plunger assembly 5 comprises a plunger body 9 and a sealing element 11 described further hereinafter. The plunger body has ends 13 and 15. The cam head assembly is well known in the art and not described in any detail save to say that has a rotary cam that is rotated by a separate actuator (not shown) and that an end 13 of the plunger bears against its cam surface so that the plunger moves axially on rotation of the cam. The end 15 of the plunger body 9 makes contact with the aforementioned carrier and movement thereof controls making and breaking of the contact sets in a manner that is well known in the art.

A housing 17 of the cam head assembly has a tulip shaped end 25 that is received in an end bore 19 of the switch assembly housing. Yoke 7 is generally U shaped and is received in recessing of the switch assembly housing aligned with apertures 23, and cooperates with the tulip end 25 to secure the switch assembly to the cam head assembly. Screws, not illustrated, secure the yoke in place.

The sealing element 11 comprises a bellows seal having an outer peripheral rim 31 that is trapped between the switch assembly housing and the tulip end 25 of the cam head housing on assembly thereof. The bellows seal further comprises an inner annular part 33 that is over molded onto the plunger body 9 where it is relieved by a groove indicated at 37. In the illustrated embodiment the relief groove 37 further comprises V-shaped troughs and ridges 41, 43 and undercutting in the form of annular grooves 47,49 that open towards one another. By means of this relieving there is a positive connection between the sealing element 11 and the plunger 9 and the tracking path for preventing liquid ingress is increased significantly. It will be apparent that the inner annular part 33 and the peripheral rim 31 are interconnected to provide the desired sealing between the switch contact housing and the cam head housing.

The figures show the bellows seal in its as made configuration and corresponding to its most leftward position as viewed in the illustration.

The plunger assembly of the invention is made in a two stage molding operation. In the first stage the plunger body 9 is made by injecting plastics into a mold to produce a plunger body having the illustrated configuration including the illustrated relieving and undercuts. Next the preformed plunger body 9 is transferred to a second mold which has relieving corresponding to the desired shape of the bellows seal 11. The desired material is then introduced into the mold to form the bellows seal as an over molding on the plunger body. The assembly is removed ready for installing into the switch mechanism as a subassembly thereof. It will be appreciated that by forming the plunger and bellows seal as an assembly, assembly of the switch mechanism is simplified as it avoids the need for the bellows seal to be assembled manually on to the plunger body.

The invention claimed is:

1. A safety switch mechanism of the type having a housing accommodating a contact assembly including at least one stationary contact and at least one movable contact carried by an axially movable carrier, an operating mechanism for the movable carrier and a plunger transmitting movement of the operating mechanism to the movable carrier, and wherein an improvement comprises the plunger carrying sealing means in a form of an annular bellows seal having a peripheral rim adapted to co-operate with a housing part and an inner peripheral rim that contacts an outer surface the plunger, and wherein the bellows seal is over-molded onto the plunger, and wherein the plunger has a relief groove for relieving the outer surface of the plunger and for accepting the bellows seal.

2. A safety switch mechanism as claimed in claim 1 in which the plunger is made from a plastics material.

3. A safety switch mechanism as claimed in claim 1 in which the plunger is molded.

4. A safety switch mechanism as claimed in claim 1 in which the material of the bellow seal is a flexible rubber-like plastics.

5. A safety switch mechanism as claimed in claim 1 in which the relief groove includes a series of troughs and recesses.

6. A safety switch mechanism as claimed in claim 1 in which the relief groove comprises at least one undercut.

7. A safety switch mechanism as claimed in claim 6 in which the relief groove comprises two undercuts disposed to face one another.

8. A plunger for a safety switch assembly comprising a plunger body having an outer surface and having over-molded thereon a bellows seal, wherein said plunger body has a relief groove for relieving the outer surface and accepting a portion of the bellows seal.

9. A plunger as claimed in claim 8 in which the plunger is made from a plastics material.

10. A plunger as claimed in claim 8 in which the plunger is molded.

11. A plunger as claimed in claim 8 in which the material of the bellows seal is a flexible rubber-like plastics.

12. A plunger as claimed in claim 8 in which the relief groove further comprises a series of troughs and ridges.

13. A plunger as claimed in claim 8 in which the relief groove comprises at least one undercut.

14. A plunger as claimed in claim 13 in which the relief groove comprises two undercuts disposed to face one another.

15. A method of making a switch plunger and seal assembly comprising forming a plunger from a first material with a relief groove inserting the formed plunger into a mold and over-molding onto an outer surface of the plunger a bellows seal having a portion received in the relief groove.

16. A method of making a switch plunger and seal assembly as claimed in claim 15 in which the plunger is formed from a plastic material in a molding process.

17. A method of making a switch plunger and seal assembly as claimed in claim 15 in which the plunger is formed with a relief groove further comprising a series of troughs and ridges.

18. A method of making a switch plunger and seal assembly as claimed in claim 17 in which the relief groove further comprises at least one undercut.

19. A method of making a switch plunger and seal assembly as claimed in claim 18 in which the relief groove further comprising two undercuts that face one another.

20. A method of making a switch plunger and seal assembly as claimed in claim 15 in which the bellows seal is molded from a flexible rubber-like plastics.

* * * * *